US006240052B1

(12) United States Patent
Kitajima et al.

(10) Patent No.: US 6,240,052 B1
(45) Date of Patent: May 29, 2001

(54) ELECTRONIC WATCH WITH CALENDAR

(75) Inventors: Yasuo Kitajima, Sayama; Takeo Mutoh, Nerima-ku; Haruhiko Higuchi, Tokorozawa; Hiroyuki Koike, Nerima-ku, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/216,413

(22) Filed: Dec. 18, 1998

(30) Foreign Application Priority Data

Dec. 26, 1997 (JP) ..... 9-359760

(51) Int. Cl.[7] ..... G04B 19/24

(52) U.S. Cl. ..... 368/28; 368/34; 368/35; 368/66

(58) Field of Search ..... 368/28, 34, 35, 368/37, 47, 66

(56) References Cited

U.S. PATENT DOCUMENTS 4,695,168 * 9/1987 Meister et al. ..... 368/28
4,733,384 * 3/1988 Meister et al. ..... 368/28

* cited by examiner

*Primary Examiner*—Bernard Roskoski
*Assistant Examiner*—Jeanne-Marguerite Goodwin
(74) *Attorney, Agent, or Firm*—Koda & Androlia

(57) ABSTRACT

To provide an electronic watch with calendar without the need to adjust the calendar when the watch is restarted.

A control mechanism 133 is provided which uses a signal from a 24-hour switch 12 which operates in synchronism with a time mechanism converter 6 as a signal for operating a date display drive converter 51 during normal watch operation, and uses a signal from a 24-hour counter which receives a signal from a time mechanism circuit 60 as a signal for operating the date display drive converter 51 at other times.

13 Claims, 7 Drawing Sheets

ELECTRONIC WATCH WITH CALENDAR

BACKGROUND OF THE INVENTION

1. Field of the Invention

This invention relates to an electronic watch with calendar having a date display.

2. Description of the Related Art

In a conventional analog electronic watch with calendar provided with a date display, the calendar also stops when the crown is pulled out to stop the hour and minute hands.

Therefore, when the watch is restarted after leaving it for a long time when the hour and minute hands have stopped in order to save power, it is troublesome to adjust the calendar and in particular, the date. Analog watches provided with an end-of-month non-correction function are of two types, i.e. a type where the user makes a correction in February of each leap year, and a type where the date at the end of the month is automatically determined over a period of several years. In general, however, a year and month display is not provided, and if the watch stops for a long time, the month or year and month are no longer determined so that it is impossible to correct the date.

It is therefore an object of this invention to provide an electronic watch with calendar which avoids the need to correct the date after stopping the hour and minute hands long time, and avoids the need to determine the year or month and year.

SUMMARY OF THE INVENTION

To achieve the above objects, this invention provides an electronic watch with calendar comprising a 24-hour switch for outputting a signal every 24 hours in synchronism with a time mechanism converter, a converter for driving a date display based on a signal from this 24-hour switch during normal watch operation, a 24-hour counter for outputting a 24-hour signal after receiving a signal from a time mechanism circuit, and a control mechanism which generates a control signal for changing over from the signal which operates the converter for driving the date display to the 24 hour counter output signal after stopping the time mechanism converter. The calendar is advanced by the 24-hour counter even after the hour and minute hands have stopped, so there is no need to update the date and adjust the calendar when the watch is restarted. Therefore the user of the watch need only adjust the hour and minute hands, or occasionally make an adjustment of the hour and minute hands or a date correction of one day. Further, in the case of an analog watch without a year and month display which automatically determines the end of the month including February and February of every leap year for a period of several years, it was difficult to determine the month and year if the watch was left on its own, but this determination is now made unnecessary.

Alternatively, the electronic watch with calendar may comprise a 24-hour switch for outputting a signal every 24 hours in synchronism with a time mechanism converter, a converter for driving a date display based on a signal from this 24-hour switch during normal watch operation, a 24-hour counter for outputting a 24-hour signal after receiving a signal from a time mechanism circuit, and a control mechanism for generating a control signal which applies this 24-hour output signal as the signal which operates the converter which drives the date display, in which case the watch functions in the same way.

If the control mechanism generates the aforesaid change-over control signal based on the position of a crown, the control mechanism may be controlled using the position in which the crown stops the time and minute hands, for example.

If the control mechanism generates the aforesaid change-over control signal based on a switch provided outside the watch, it is possible to change over freely to the 24-hour counter, so the user can make a choice as to whether to stop the watch completely or allow the calendar to continue operating alone.

If the control mechanism generates the aforesaid control signal based on a voltage detection signal, power can be saved when the watch is left on its own with low batteries, so the calendar can be kept running for a long period of time.

If the 24-hour counter starts operating when it receives the control signal from the control mechanism, the power consumption of the 24-hour counter can be reduced.

If the 24-hour counter operates in synchronism with the time mechanism circuit when the watch is operating normally, it can be adjusted to match the speed of the ordinary time mechanism circuit, and a change of date can always be made at an appropriate time.

Further, if a slip mechanism is interposed between the minute hand fixed wheel and the hour hand fixed wheel, and a regulating means is provided to regulate the rotation of the crown, it is possible to prevent the crown from rotating, and thereby to prevent the 24-hour switch from operating and the date from changing incorrectly after changing over to the 24-hour counter, due to the magnitude of the slip torque of the slip mechanism.

Moreover, if the 24-hour counter is reset every time the 24-hour switch is operated, the advance rate of the 24-hour counter and the advance rate of the hour and minute hands can be matched to each other.

DESCRIPTION OF THE PREFERRED EMBODIMENTS

Figure 1:
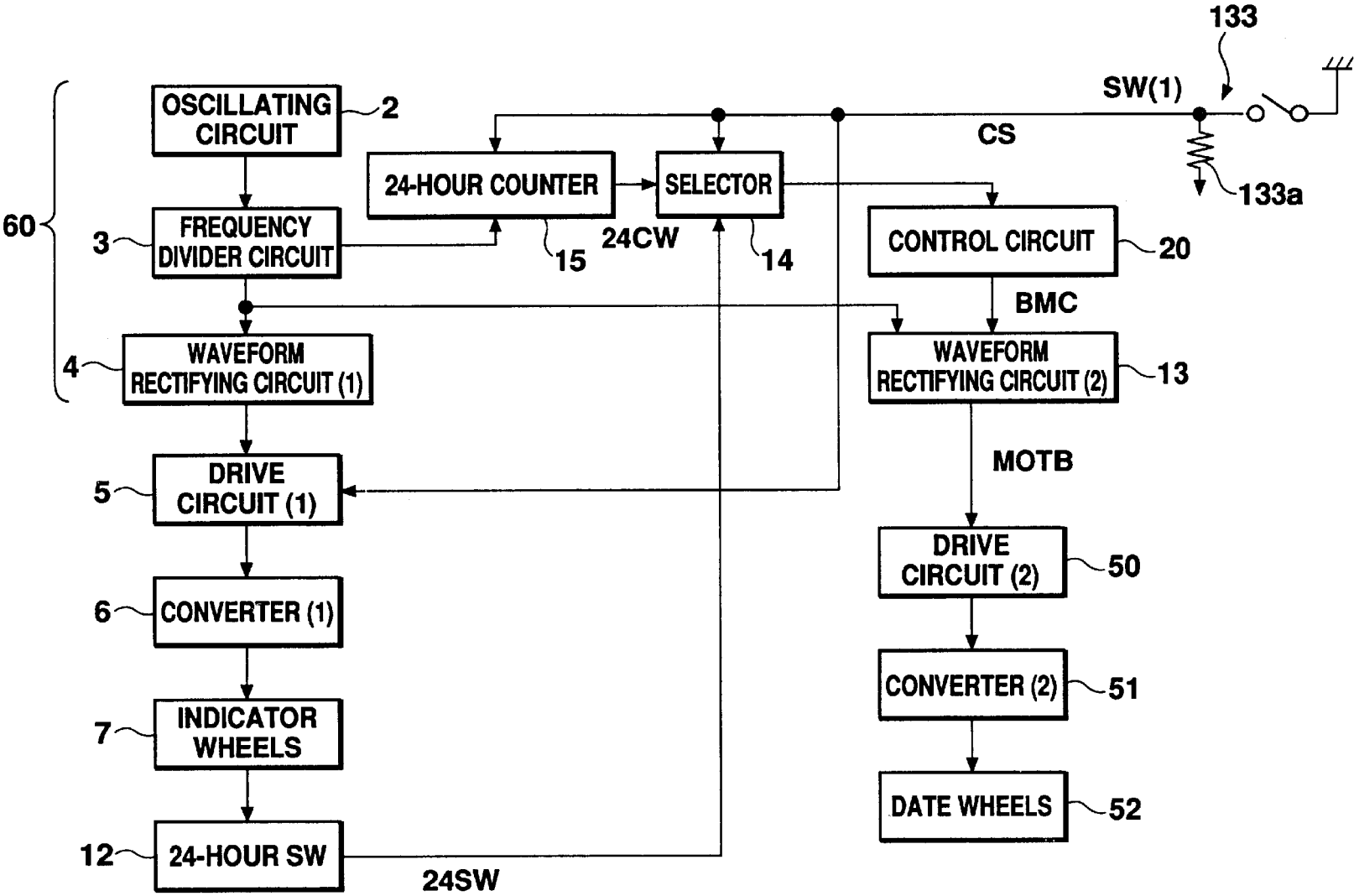
FIG. 1 is a block diagram showing the circuit layout of an electronic watch with a calendar according to this invention.

Some embodiments of the invention will now be described referring to the drawings.

FIG. 1 is a block diagram showing the circuit layout of an electronic watch with calendar according to this invention.

In FIG. 1, a signal from the oscillating circuit 2 which causes a crystal oscillator to oscillate is frequency divided up to 1 Hz by a frequency divider circuit 3, waveform rectified by the waveform rectifying circuit (1) 4, and sent to a drive circuit (1) 5 which drives a converter (1) 6 such as a step motor or the like. The oscillating circuit (2), frequency divider circuit (3) and waveform rectifying circuit (1) 4 are referred to as a time mechanism circuit 60. A signal from the drive circuit (1) 5 drives the converter (1) 6 every second. The rotation torque from the converter (6) is transmitted to a series of indicator wheels 7 to rotate the second hand, minute hand and hour hand. It also rotates a switch 11 (shown in FIG. 5 hereafter) which performs one rotation in 24 hours so as to switch a 24 hour switch 12 ON every 24 hours. Also, a 24 hour counter 15 counts 24 hours based on a signal from the frequency divider circuit 3, and outputs a signal once every 24 hours.

A signal (date indicator drive signal) 24SW for driving a date indicator plate from this 24 hour switch 12, is input to a control circuit 20 via a selector 14 which changes over between a signal from the 24-hour counter 15 and this signal 24SW from the 24 hour switch 12.

When the control circuit 20 receives the signal 24SW, it sends a command signal (date indicator plate drive signal) BMC for driving the date indicator plate to a waveform rectifying circuit (2) 13, the waveform rectifying circuit (2) 13 rectifies the signal from the frequency divider circuit 3 and sends a drive signal MOTB which drives a converter (2) 51 for driving the date indicator plate display such as a step motor to a drive circuit (2) 50. The drive circuit (2) 50 drives the converter (2) 51, and the converter (2) 51 drives a series of date wheels 52. The date indicator plate is driven by these date wheels 52.

A control mechanism 133 is provided which comprises a switch SW(1). 133*a* is a switch resistor. When this switch SW(1) is switched on, a control signal CS is generated. This signal CS is input to the drive circuit (1) 5, and stops the converter (1) 6 which is the time mechanism converter. It is also input to the 24 hour counter 15, and starts it. As mentioned above, the 24-hour counter 15 is a circuit which counts the signals from the frequency divider circuit 3, and it outputs a signal 24CW once every 24 hours. In this embodiment, when this SW(1) is switched ON, the control signal CW is received and counting begins. The control signal CS also activates the selector 14 which changes over from the signal 24SW from the 24-hour switch to the signal 24CW from the 24-hour counter. As a result, the control circuit 20 supplies the date indicator plate drive signal BMC to drive the date wheels 52 every 24 hours even after the time mechanism converter has stopped, as stated.

The switch 133 which is the control mechanism in FIG. 1 is shown as a simple switch, but it may also be made to operate depending on the position of the crown of the watch. It may also be a special switch that can be operated from outside the watch.

Figure 2:
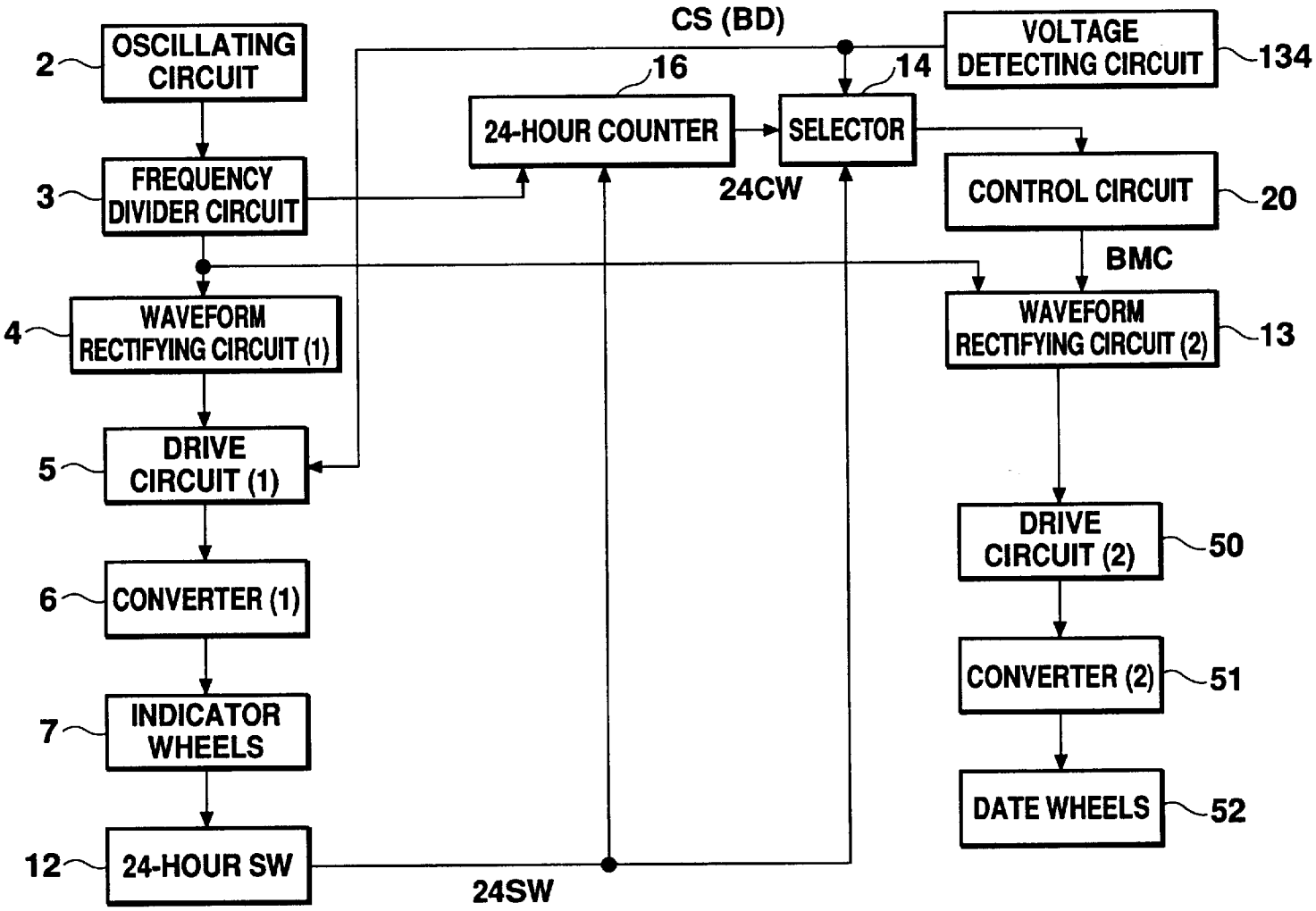
FIG. 2 is a block diagram showing the circuit layout of an electronic watch with a calendar according to another embodiment of this invention.

FIG. 2, which shows another embodiment of this invention, is a block diagram of a circuit layout corresponding to that of FIG. 1. In FIG. 2, component elements corresponding to those of FIG. 1 are given identical symbols. In FIG. 2, a detection signal BD from a voltage detection circuit 134 is used as the control signal CS. The date indicator plate drive signal 24SW from the 24-hour switch 12 is supplied to the control circuit via the selector 14 as described in FIG. 1, and during normal watch operation, the date indicator plates 52 are driven in the same way as in FIG. 1 by this route. During normal watch operation, a 24-hour counter 16 continues to operate, counting the signals from the frequency divider circuit 3. When the date indicator plate drive signal 24SW is applied to the 24-hour counter 16, it resets the 24-hour counter and matches the advance rate of the time mechanism wheels (indicator wheels) 7 to the advance rate of the 24-hour counter 16.

In the voltage detection circuit 134, the detection signal BD is output when it is determined that the voltage has dropped. This signal functions as the control signal CS described hereabove, stops the drive circuit (1) 5, and the selector 14 changes from the signal which starts the converter (2) 51 for driving the date display to the signal 24CW from the 24 hour counter 15. In this case, the voltage detection circuit 134 functions as a control mechanism, saves power, and maintains calendar operation over a long time period.

Figure 3:
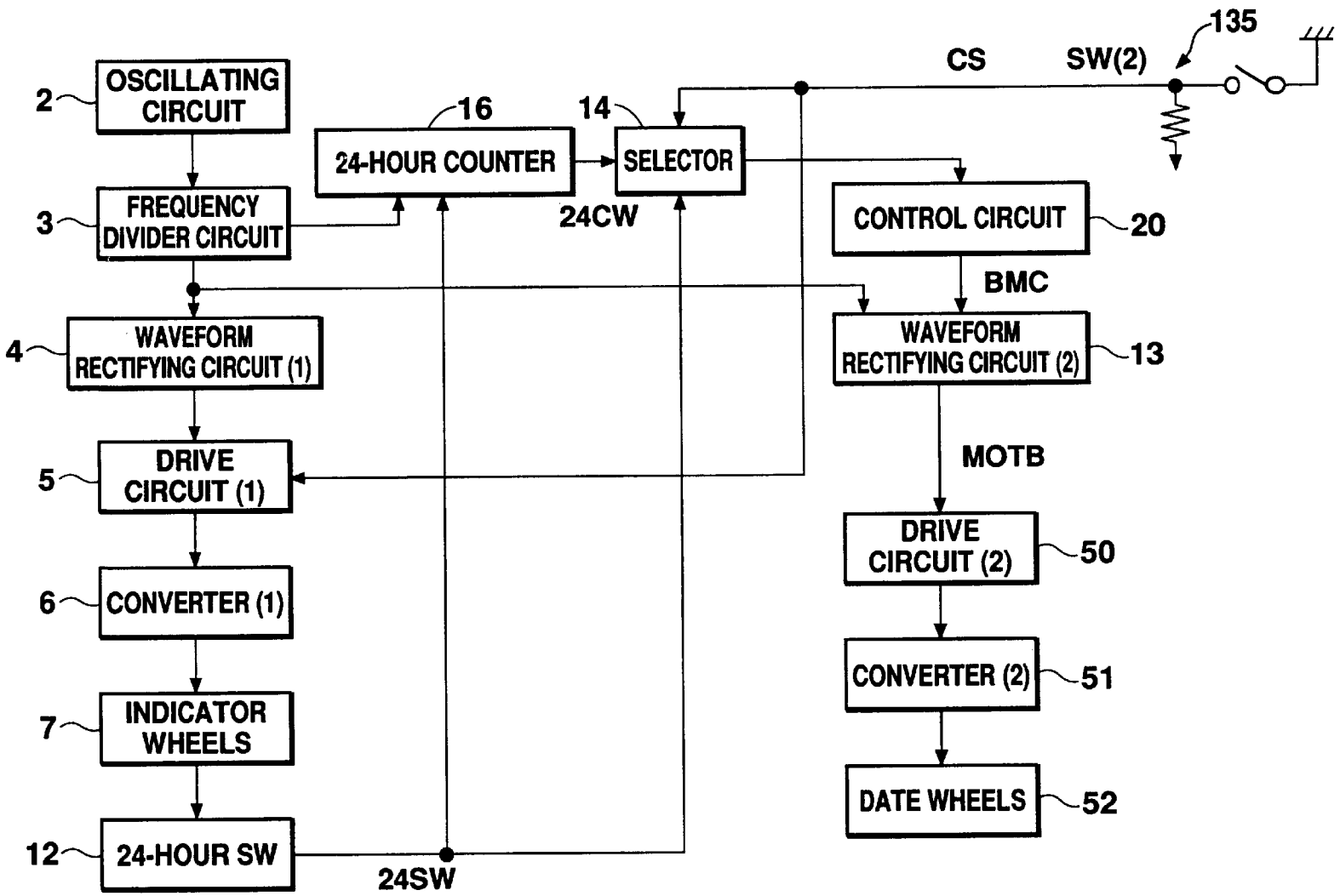
FIG. 3 is a block diagram showing the circuit layout of an electronic watch with a calendar according to another embodiment of this invention.

FIG. 3 is a block diagram of a circuit layout corresponding to FIG. 1 showing another embodiment of this invention. Components which are identical to those of FIG. 1 are given identical symbols.

Here also, the 24-hour counter 16 continues operating, counting signals from the frequency divider circuit 3. Each time the date indicator plate drive signal 24SW from the 24-hour switch 12 is input, the counter is reset. A switch SW(2) 135, which is a control mechanism, supplies the control signal CS to the drive circuit (1) 5 to stop it operating, and the selector 14 changes over from the date indicator plate drive signal 24SW to the signal 24CW from the 24-hour counter 16 which is supplied to the control circuit 20. This allows the advance rate of the 24-hour counter 16 to be matched to the time mechanism indicator wheels, and after the indicator wheels 7 have stopped, only the calendar is sent by the 24-hour counter so that the rate of advance of the calendar is maintained.

Figure 4:
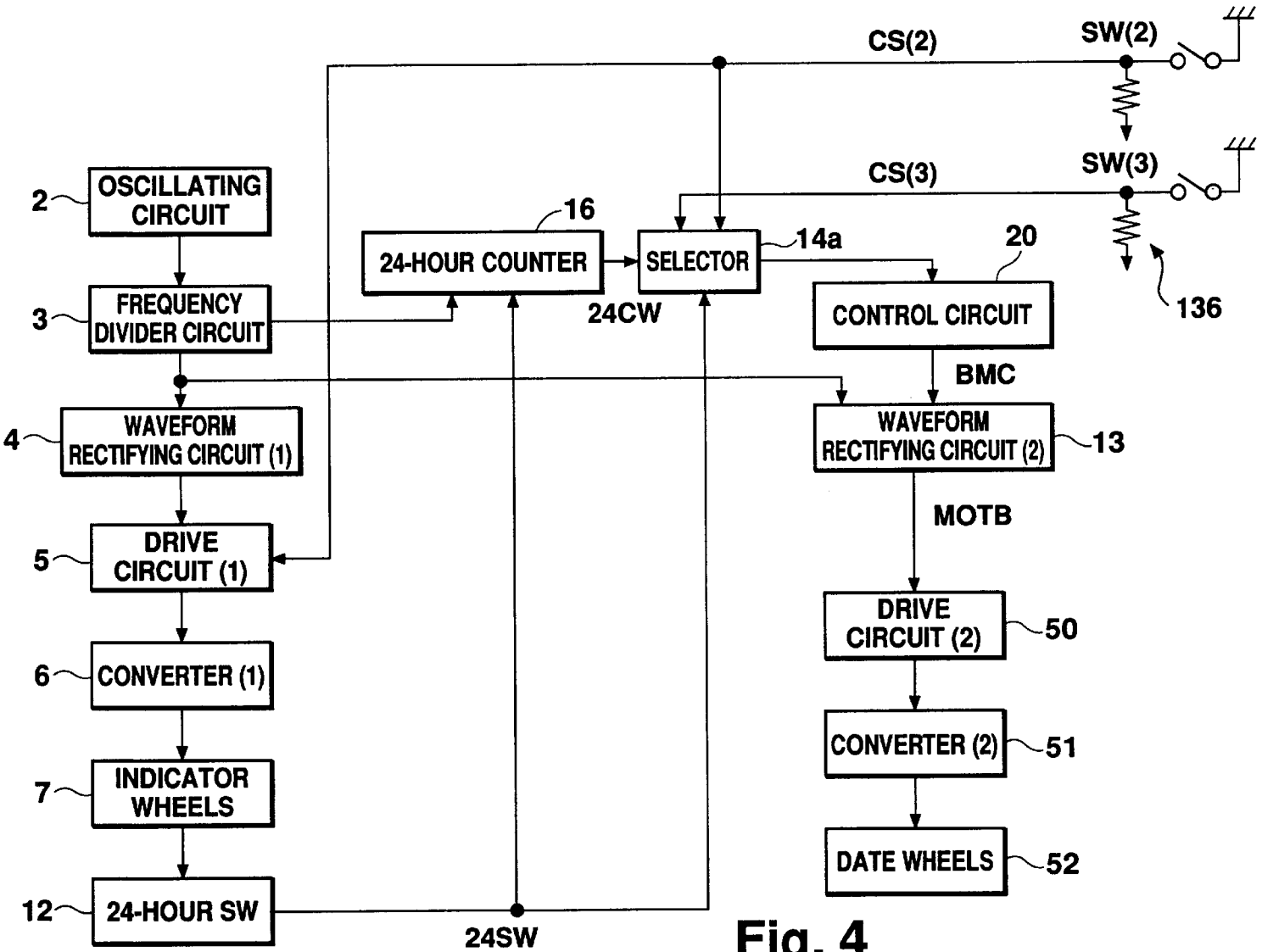
FIG. 4 is a block diagram showing the circuit layout of an electronic watch with a calendar according to another embodiment of this invention.

FIG. 4 is a block diagram of a circuit layout corresponding to FIG. 1 and FIG. 3 showing another embodiment of this invention. Components which are identical to those of FIG. 1 and FIG. 3 are given identical symbols. The features of this embodiment are that a control mechanism 136 comprises two switches SW(2) and SW(3), and that a selector 14*a* changes over between a state wherein only the signal 24SW is allowed to pass and a state wherein both the signals 24SW and 24CW are allowed to pass. A specific example of an electronic watch corresponding to this embodiment is described hereafter. In a position 2 wherein the crown has been pulled out two steps to adjust the indicators, SW(2) is switched ON (SW(3) is then OFF). In a position 1 where the crown has been pulled out one step to correct a time difference or to adjust the calendar, SW(3) is switched ON (SW(2) is OFF at this time).

The 24-hour counter 16 is normally constantly counting signals from the frequency divider circuit 3, and is reset by the date indicator plate drive signal 24SW from the 24-hour switch 12. The signal 24SW is supplied via the selector 14 to the control circuit 20 during normal operation (crown position 0), and the control circuit 20 outputs the date indicator plate drive signal BMC to drive the date indicator plates 52 as shown in FIG. 1 and FIG. 3.

In crown position 1, the switch SW(2) is switched ON, the control signal CS(3) is input to the selector 14*a*, so the selector 14*a* allows both the signal 24CW from the 24-hour counter 16 and the signal 24SW from the 24-hour switch 12 to pass, and these signals are supplied to the control circuit 20. This is because in position 1 for correcting a time difference, the time mechanism converter (1) 6 must also be operated at normal speed.

In crown position 2, when the switch SW(2) is switched ON, the control signal CS(2) stops the drive circuit (1) 5, and the selector 14*a* supplies the signal 24CW from the 24-hour counter 16 to the control circuit 20. In this case also, the selector 14*a* allows both the signal 24SW and the signal 24CW to pass. Here, when the crown stops in position 2, there is very little possibility that the 24-hour switch will switch ON if the crown is left in that position. However if the crown is left in position 1 for correcting a time difference, the time mechanism converter (1) 6 is still operating at the normal rate, so it is important to prevent the crown from rotating to avoid subsequent incorrect operation.

A specific form of this embodiment will now be described.

Figure 5:
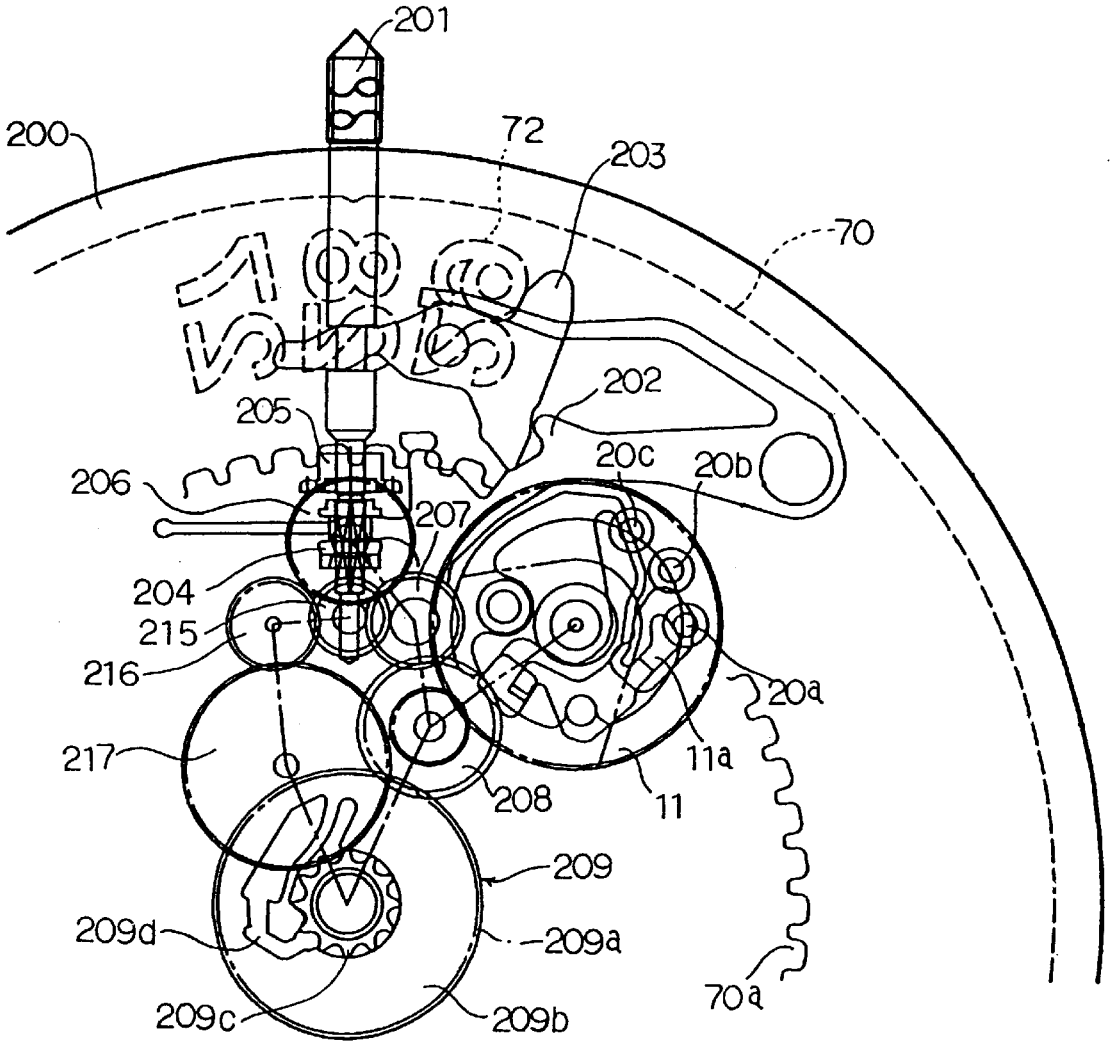
FIG. 5 is a partial diagram of positional relationships inside a mechanism viewed from the upper face of an electronic watch incorporating the features of the embodiment of FIG. 4.
Figure 6:
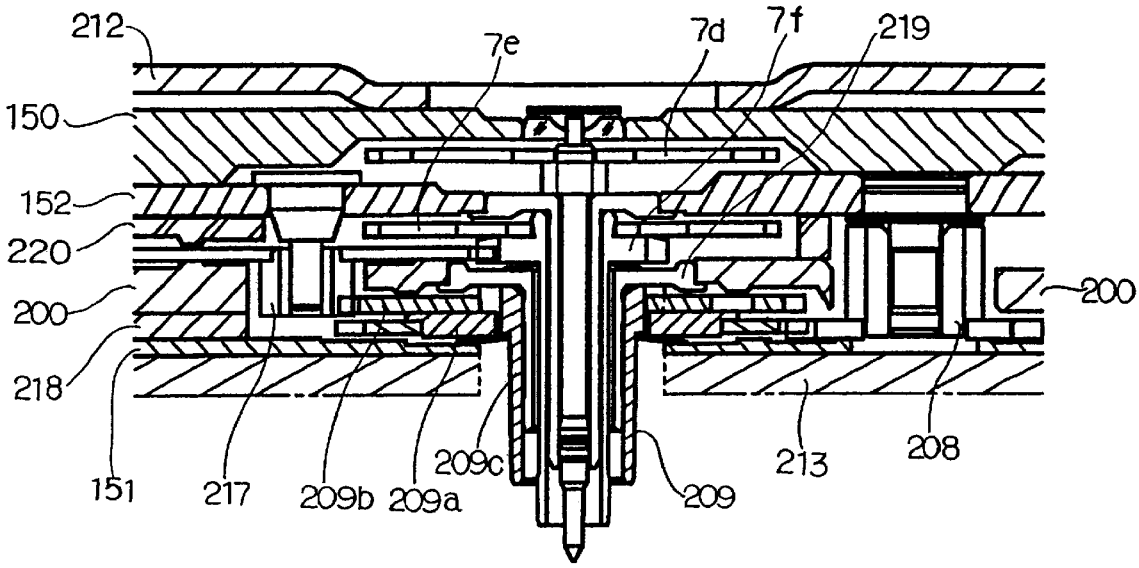
FIG. 6 is a sectional view along a series of time difference wheels. The figure is separated into (a) and (b) for convenience.
Figure 6:
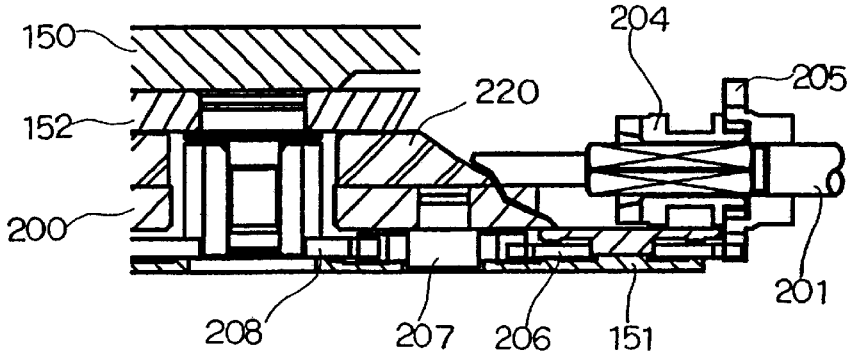
Figure 7:
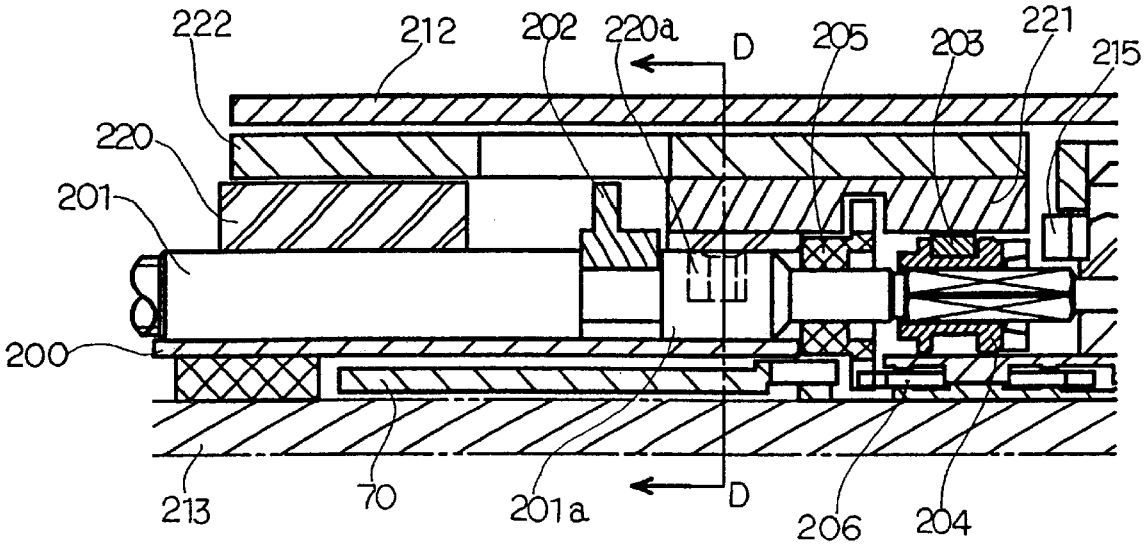
FIG. 7 is a sectional view in the vicinity of a stem in the specific embodiment shown in FIG. 5. (b) is a section along a line D—D in (a).
Figure 7:
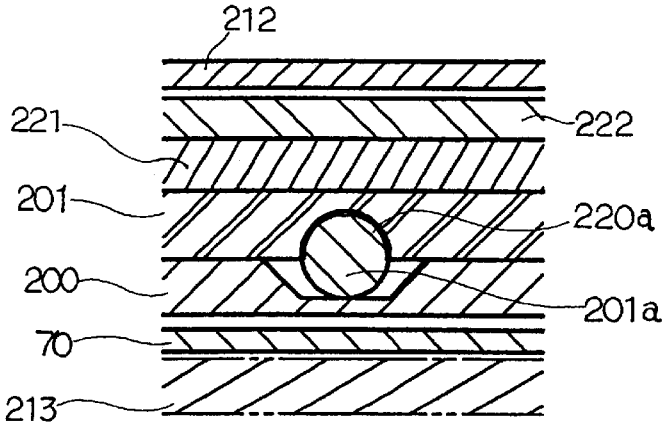

FIGS. 5–7 show a specific form of this embodiment.

First, the interconnections and positional relationship of the hour wheel, indicator correction wheels, time difference correction wheels and switch wheel 11 in a watch incorporating the specific features of this embodiment will be described. FIG. 5 is a partial view of the positional relationships inside a movement seen from above the watch (rear cover side). FIG. 6 is a sectional view from a stem 201 of FIG. 5 along time difference correction wheels including an hour correction wheel (1) 205, hour correction wheel (2) 206, hour correction wheel (3) 207, switch intermediate wheel 208 and hour wheel 209, and minute wheel 217. FIG. 6 is divided into (a) and (b) for convenience so that the figure may be reconstructed by aligning the parts of the switch intermediate wheel 208.

A control mechanism (rear rotation mechanism) 135 comprising the stem 201, a setting lever 202 and a clutch 203 (in FIG. 6, this part is omitted) is mounted on a base plate 200. This control mechanism 135 determines the positions of the stem 201 and the crown which is fixed to it. In FIG. 5, the crown is in position 0 which is the normal operating state of the watch.

A clutch wheel 204 and the time difference correction wheel (1) 205 engage with the stem 201. In position 0 of the stem 201 (crown), the rotation of the stem 201 (crown) is not transmitted to any of the wheels.

Position 1 in which the stem 201 is pulled out one step, is the position in which time difference correction and calendar adjustment are performed. FIG. 6 shows the case when the stem is in this position. When the stem 201 is in this position, the rotation of the stem 201 is transmitted via the clutch wheel 204 to the hour correction wheel (1) 205 which rotates together with the stem 201 and is supported free to slide, to the hour correction wheel (2) 206 which engages with the wheel 205, to the hour correction wheel (3) 207, and to the switch intermediate wheel 208 which engages with the wheel 207. These wheels are supported by the base plate 200 or between an intermediate bridge 152 and a date indicator maintaining plate 151.

The gear of the switch intermediate wheel 208 engages with an upper wheel 209*a* of the hour wheel 209, this wheel comprising the upper wheel 209*a* (hour hand fixed wheel) to which hour hand is fixed and a lower wheel 209*b* slip-joined to the upper wheel, and the pinion of the switch intermediate wheel 208 engages with the switch wheel 11 forming the 24-hour switch 12. Therefore, in position 1 of the stem 201 (crown), when the stem 201 (crown) is rotated, the hour hand rotates and the 24-hour switch 12 is driven. The upper wheel 209*a* and the lower wheel 209*b* of the common wheel 209 are joined free to slip relative to each other by an hour wheel pinion 209*c* fixed to the upper wheel 209*a* and an hour wheel pinion restraining spring 209*d* formed in one-piece with the lower wheel 209*b*. This hour wheel 209 is supported by a wheel seat 219 fixed to the base plate 200.

As a result, a rotation of the hour wheel in position 1 of the stem is not transmitted to the minute wheel 217 described hereafter. The minute wheel is supported between the intermediate bridge 152 and the base plate 200.

A switch spring 11*a* is mounted on the switch wheel 11, rotates together with the switch wheel 11, comes in contact with three switch terminals 20*a*, 20*b*, 20*c* connected to the selector 14*a*, and outputs the 24-hour switch signal 24SW.

Position 2 wherein the stem 201 (crown) is pulled out two steps, is the position in which indicator adjustment is performed. When the stem 201 is in position 2, the clutch wheel 204 which is joined to the edge of the stem 201 engages with a setting wheel 215, while the rotation of the stem 201 is transmitted to a minute intermediate wheel 216, the minute wheel 217 and a cannon pinion fixed to the minute hand (minute hand fixed wheel) 7*f* which engages with an engaging part of the minute wheel 217, and transmitted to the lower wheel 209*b* which engages with a pinion part of the minute wheel 217. In this case, rotation is transmitted to the switch intermediate wheel 208 which engages with the upper wheel 209*a* and to the switch wheel 11 without slipping. This is due to the fact that the slip joining force between the aforesaid lower wheel 209*b* and upper wheel 209*a* is set larger than the rotation torque which rotates the switch intermediate wheel 208. Hence, in position 2 of the stem (indicator adjusting position), the switch wheel 11 also operates in synchronism.

The outer circumference of a date indicator plate 70 is shown by a dotted line, and an inner circumferential date gear 70*a* is shown by a solid line in FIG. 5.

In FIG. 6, 7*d* is a fourth wheel to which the second hand is fixed, 7*e* is a second wheel and 7*f* is a common pinion. These wheels are supported by the base plate 200, a wheel bridge 150 and the intermediate bridge 152. 211 is a spacer, 212 is a circuit supporting plate and 218 is a rear plate.

Next, when the stem 201 (crown) is left in, for example, the aforesaid position wherein time difference correction and calendar adjustment are performed, in which the stem 201 is pulled out one step, updating of the date is performed by the 24-hour counter.

However, when the slip joining force between the hour wheel pinion restraining spring formed on the lower wheel of the hour wheel and the common pinion is large, the crown (although not shown in FIG. 5 and FIG. 6, a waterproof ring is attached to the crown which is in intimate contact with the case) also rotates via the time difference correction wheels, and the switch wheel 11 could also be rotated. A mechanism for preventing rotation of the stem 201 at this time will now be described.

FIG. 7 is a sectional view of a watch according to this invention in the vicinity of the stem 201 showing the case where the stem 201 is in position 0 for normal operation of the watch. FIG. 7(*b*) is a sectional view along a line D—D in FIG. 7(*a*).

In FIG. 7(*a*) and (*b*), the stem 201 is gripped between the base plate 200 and a plastic stem spacer 220 such that it is free to rotate. The setting lever 202 engages with the small diameter of the stem 201, and determines each of the pull-out positions 0, 1 and 2 of the stem. Also, the hour correction wheel (1) 205 engages with a round shaft at the tip of the stem, and the clutch wheel 204 engages with a rectangular part of the tip of the stem.

These wheels are housed in a clutch wheel seat 221. The clutch 203 engages with the small diameter of the clutch wheel 204, and operates in synchronism with it due to the pull-out position of the stem and the action of the clutch 203 and setting lever 202. In position 0 of the stem (the position shown in FIG. 7(*a*)), the clutch wheel 204 is not engaged with any of the wheels. In position 1, the clutch wheel 204 engages with the time difference correction wheel (1) 205 (FIG. 6(*b*)) so that a time difference correction and calendar adjustment can be made.

In position 2 of the stem, the clutch wheel 204 engages with the setting wheel 215 so that indicator adjustment can be made.

The stem 201 is supported so that its middle part 201*a* is enclosed by the stem spacer 220, and a trapezoidal projection 220*a* extends from the stem spacer 220 facing this middle part 201*a*. The middle part 201*a* of the stem 201 is thereby held firm due also to the fact that them stem spacer 220 is only slightly elastic, so a rotation of the stem (crown) is limited. Herein, the middle part 201*a* of the stem and the projection 220*a* of the stem spacer 220 function as a limiting means.

In the aforesaid FIG. 7, the stem is shown in position 0, but the middle part 201*a* of the stem also comes in contact with the projection 220*a* of the stem spacer 220 in position 1 of the stem, and the same limitation to rotation of the crown applies.

Still further in FIG. 7, 222 is a rotation base plate and 212 is a circuit supporting plate. The remaining components were described for FIG. 6 and are given the same symbols as in FIG. 6.

As described above, according to this invention, a watch calendar can be continuously advanced due to a signal from a 24-hour counter which continues operating when it receives a signal from a time mechanism circuit even after a time mechanism converter has stopped, and there is no need to adjust the calendar when the watch is restarted. The user of the watch therefore merely has to adjust the hour and minute hands, or occasionally, the hour and minute hands and one day on the date.

This invention is moreover particularly effective in making the troublesome determination of year and month unnecessary when used in an analog watch which has a 10,000 year calendar but does not have a year and month display.

What is claimed is:

1. An electronic watch with calendar comprising:

a 24-hour switch for outputting a signal every 24 hours in synchronism with a time mechanism converter, a converter for driving a date display based on said signal from said 24-hour switch during normal watch operation, a 24-hour counter for outputting a 24-hour signal when it receives a signal from a time mechanism circuit, and a control mechanism for applying said 24 hour counter output signal to the converter for driving said date display after stopping said time mechanism converters, instead of said signal from said 24 hour switch.

2. An electronic watch with calendar comprising:

a 24-hour switch for outputting a signal every 24 hours in synchronism with a time mechanism converter, a converter for driving a date display based on a signal from said 24-hour switch during normal watch operation, a 24-hour counter for outputting a 24-hour signal when it receives a signal from a time mechanism circuit, a control mechanism for generating a control signal which applies said 24-hour output signal as a signal for operating the converter which drives the date display.

3. An electronic watch with calendar as defined in claims 1 or 2, wherein said control mechanism generates said control signal based on a crown position.

4. An electronic watch with calendar as defined in claims 1 or 2, wherein said control mechanism generates said control signal based on a switch provided outside the watch.

5. An electronic watch with calendar as defined in claims 1 or 2, wherein said control mechanism generates said control signal based on a voltage detection signal.

6. An electronic watch with calendar as defined in claims 1 or 2, wherein said 24-hour counter starts operating when it receives said control signal from said control mechanism.

7. An electronic watch with calendar as defined in claims 1 or 2, wherein said 24-hour counter functions in synchronism with said time mechanism circuit during normal watch operation.

8. An electronic watch with calendar as defined in claim 3, comprising:

a slip mechanism interposed between a minute hand fixed wheel and an hour hand fixed wheel in a series of watch wheels, and regulating means for regulating the rotation of said crown.

9. An electronic watch with calendar as defined in claims 1 or 2, wherein said 24-hour counter is reset every time said 24-hour switch is operated.

10. An electronic watch with calendar as defined in claim 7, wherein said 24-hour counter is reset every time said 24-hour switch is operated.

11. An electronic watch with calendar as defined in claim 3, wherein said 24-hour counter starts operating when it receives said control signal from said control mechanism.

12. An electronic watch with calendar as defined in claim 4, wherein said 24-hour counter starts operating when it receives said control signal from said control mechanism.

13. An electronic watch with calendar as defined in claim 5, wherein said 24-hour counter starts operating when it receives said control signal from said control mechanism.

* * * * *